United States Patent [19]

Dederer et al.

[11] Patent Number: 4,920,754

[45] Date of Patent: May 1, 1990

[54] SYSTEM FOR DUMPING CRYOGENS IN A SUPERCONDUCTING SOLENOID INSTALLATION

[75] Inventors: Jeffrey T. Dederer, Penn Hills; Donald T. Hackworth, Monroeville, both of Pa.

[73] Assignee: Westinghouse Electric Corp., Pittsburgh, Pa.

[21] Appl. No.: 306,360

[22] Filed: Feb. 6, 1989

[51] Int. Cl.[5] ..... F17C 1/00

[52] U.S. Cl. ..... 62/53.1; 62/260; 165/45; 174/15.4; 335/300; 505/897

[58] Field of Search ..... 62/51.1, 53.1, 260, 62/259.2; 165/45; 174/15.4; 335/216, 300; 505/897

[56] References Cited

U.S. PATENT DOCUMENTS

| | | | |
|---|---|---|---|
| 3,543,530 | 12/1970 | Brennen et al. | 62/53.1 |
| 3,686,422 | 8/1972 | Doose | 174/15 |
| 3,801,942 | 4/1974 | Elsel | 335/216 |
| 3,869,686 | 3/1975 | Benz | 335/216 |
| 4,122,512 | 10/1978 | Peterson et al. | 363/14 |
| 4,418,325 | 11/1983 | Elsel | 335/216 |
| 4,421,946 | 12/1983 | Furuto et al. | 174/128 |
| 4,447,670 | 5/1984 | Eckels | 174/15 |
| 4,482,878 | 11/1984 | Burgeson et al. | 335/216 |
| 4,549,156 | 10/1985 | Mine et al. | 335/216 |
| 4,554,407 | 11/1985 | Ceresara et al. | 174/128 |
| 4,568,900 | 2/1986 | Agatsuma et al. | 335/216 |
| 4,583,372 | 4/1986 | Egan et al. | 62/51.1 |
| 4,622,531 | 11/1986 | Eyssa et al. | 335/216 |
| 4,652,697 | 3/1987 | Ando et al. | 174/128 |
| 4,665,611 | 5/1987 | Sadakata et al. | 29/599 |
| 4,687,883 | 8/1987 | Flükiger et al. | 174/126 |
| 4,692,560 | 9/1987 | Hotta et al. | 174/15 |
| 4,702,825 | 10/1987 | Selvaggi et al. | 209/224 |
| 4,739,202 | 4/1988 | Hatanaka et al. | 310/52 |
| 4,743,713 | 5/1988 | Scanlan | 174/128 |

FOREIGN PATENT DOCUMENTS

| | | |
|---|---|---|
| 2205414 | 8/1978 | Fed. Rep. of Germany . |
| 56186891 | 1/1984 | Japan . |
| 2021881 | 5/1979 | United Kingdom . |

*Primary Examiner*—Ronald C. Cappossela

[57] ABSTRACT

In an installation including a superconducting solenoid coil in the form of an annulus having a vertical axis, a first vessel having an annular form and enclosing the coil for containing a primary cryogen at a temperature sufficient to maintain the coil superconductive, and at least one second vessel having an annular form and enclosing the first vessel for containing a secondary cryogen at a selected temperature, there are provided: cryogen storage containers spaced horizontally from the coil and the vessels for receiving the cryogens contained in the vessels; and conduit systems coupled between the vessels and the storage containers for permitting the flow of cryogens therebetween.

13 Claims, 2 Drawing Sheets

SYSTEM FOR DUMPING CRYOGENS IN A SUPERCONDUCTING SOLENOID INSTALLATION

BACKGROUND OF THE INVENTION

The present invention relates to superconducting solenoid installations, and particularly to a system for receiving cryogens when they must be removed from the vessels surrounding a solenoid.

The unique electrical properties of superconductors have led to proposals for storing large quantities of electrical energy in large superconducting coils, one type of which would be an annular solenoid installed, possibly below ground, so that its axis is vertical. The proposed solenoids would have a substantial axial height and diameter, the diameter possibly being of the order of 500 to 1000 meters or more.

The superconductive materials which are currently usable in practice, such as NbTi, must be maintained at a temperature in the vicinity of 1–4° K in order to exhibit superconducting properties. Such temperatures can be established by surrounding the superconducting material with successive envelopes of cryogens having progressively higher boiling points.

For example, it is known to use, for this purpose, an envelope of helium, which can be made to have a boiling point lower than 4° K., surrounded by an envelope of neon, having a boiling point of in the vicinity of 28° K, the latter being surrounded by an envelope of nitrogen, having a boiling point in the vicinity of 77°K. Each of these cryogens is maintained in the liquid state by a suitable refrigeration system.

During the operation of a superconducting device of the type described above, conditions can occur which result in a loss of superconductivity, accompanied by the generation of heat which causes the cryogens surrounding the solenoid to begin vaporizing. If this should occur, the cryogens must be purged as rapidly as possible in order to avoid a rapid, and possibly destructive, pressure increase.

In addition, there are occasions when the cryogens must be purged in order to permit maintenance or repair operations to be performed on the coil.

In either event, it is desirable to be able to save the cryogens in liquid form so that they will not be lost to the atmosphere or require an impractically large storage container.

It has previously been proposed to remove the helium employed in such a system to a storage tank located below the coil. This requires a relatively large conduit between the helium vessel surrounding the coil and the storage tank and involves an overall increase in the height of the installation. When the installation is to be installed below ground level, this entails an increase in the depth of the trench which must be dug to house the installation.

In addition, during cooling of the solenoid to the temperature required to establish superconductivity, the coil tends to undergo a significant contraction in the radial direction unless it is rigidly constrained. The cryogen vessels will also experience significant radial contractions. In the structures which have previously been proposed, movement of the helium vessel must be accompanied by movement of the storage tank and piping therebelow, which creates significant construction problems. Construction problems are complicated by the fact that at least the helium vessel must be supported by a structure surrounding the helium storage tank.

SUMMARY OF THE INVENTION

It is an object of the present invention to provide an installation of the type described above which obviates such problems.

A more specific object of the invention is to provide an installation in which the helium tank is located so as not to increase the overall structural height of the installation and so as to enable the coil and its associated cryogen vessels to be directly supported on a foundation, which can be of concrete.

Another object of the invention is to permit cryogen to be rapidly removed from the vessel enclosing the coil without requiring the provision of valves having a large flow cross section.

A further object of the invention is to allow the temperature of the coil to vary in a more uniform manner during transitions between ambient temperature and cryogenic temperatures.

Yet another object of the invention is to permit removal of all cryogens when necessary, in a multiple cryogen system.

The above and other objects are achieved, according to the present invention, in an installation including a superconducting solenoid coil in the form of an annulus having a vertical axis, a first vessel having an annular form and enclosing the coil for containing a primary cryogen at a temperature sufficient to maintain the coil superconductive, and at least one second vessel having an annular form and enclosing the first vessel for containing a secondary cryogen at a selected temperature, by the provision of; cryogen storage means spaced horizontally from the coil and the vessels for receiving the cryogens contained in the vessels; and conduit means coupled between the vessels and the storage means for permitting the flow of cryogens therebetween.

DESCRIPTION OF THE PREFERRED EMBODIMENTS

Figure 1:
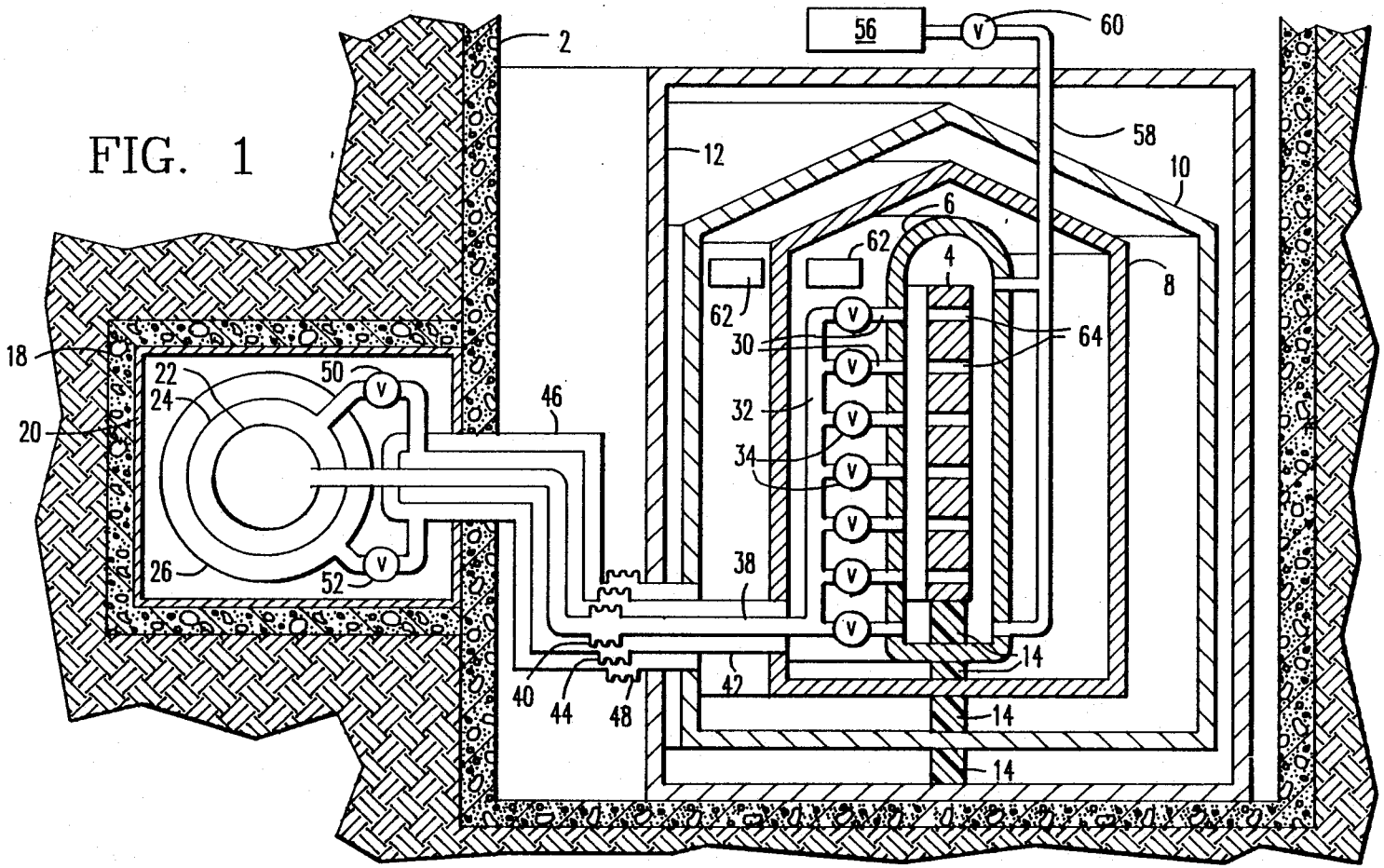
FIG. 1 is a cross-sectional view of a preferred embodiment of an installation according to the present invention.

FIG. 1 shows an installation disposed in a trench below ground level, the trench being lined with a concrete lining 2 including a concrete floor, or footer. Within concrete lining 2 there is disposed an annular solenoid coil 4 constituted by a conductor of superconducting material, such as NbTi, in a suitable support structure, the conductor being formed into a large number of turns extending around a vertical axis.

Surrounding coil 4 is a first cryogen storage vessel, or dewar, 6 for holding a bath of liquid helium. Vessel 6 is surrounded by a vessel 8 for holding a bath of liquid neon, while vessel 8 is, in turn, surrounded by a vessel 10 for holding a bath of liquid nitrogen. Each of vessels 6, 8 and 10 forms a sealed enclosure composed of a single layer of a suitable metal, such as aluminum or stainless steel. Helium vessel 6 can be covered with a layer of insulating material to provide improved insulation. Finally, vessel 10 is enclosed by a vacuum vessel 12. As illustrated, vessels 6, 8, 10 and 12 are annular structures which extend around the entire circumference of coil 4.

Vacuum vessel 12 can be disposed to bear directly upon the floor of concrete lining 2, while each of the other vessels and coil 4 are supported by a plurality of pedestals 14. Each pedestal 14 is made of an electrically and thermally insulating material having suitable mechanical strength. For example, use can be made of an epoxy-glass composite, such as material sold under the tradename "G10". The pedestals 14 for supporting each component are distributed at intervals around the circumference of the installation.

Coil 4 and vessels 6, 8 and 10 will additionally be provided with radial supports which would be constructed according to prior art teachings and which are not illustrated in FIG. 1 because they do not form a part of the present invention.

The interior of each of vessels 6, 8 and 10 is connected to a suitable refrigeration system (not shown) for maintaining the cryogen therein in a liquid state.

For storing the cryogens in the event the vessels 6, 8 and 10 must be purged, there is provided, to one side of lining 2, an excavated space provided with a further concrete lining 18. Within lining 18 there is provided a further vessel 20 within which a vacuum is maintained and within which there are disposed three nested storage tanks 22, 24 and 26. Each of these tanks, which is shown only in single line form for the sake of simplicity, has the form of an elongated cylinder with a horizontal axis. Tanks 22, 24 and 26 can be supported in any suitable manner.

The storage assembly is preferably disposed radially inwardly of the trench provided with lining 4. A plurality of such storage tank assemblies is spaced at regular intervals around the circumference of the installation.

Each storage tank assembly is associated with a conduit system for transferring cryogens between vessels 6, 8 and 10, on the one hand, and tanks 22, 24 and 26, on the other hand. This conduit system includes a plurality of pipes 30 connected between the interior of vessel 6 and a manifold 32 via respective remotely controllable valves 34. Pipes 30 are distributed vertically along the radial interior side of vessel 6 in order to achieve a rapid and uniform transfer of cryogen. Manifold 32 communicates via a further pipe 38 having a radial portion containing a bellows 40 to storage tank 22.

The interior of vessel 8 is connected to storage tank 24 via a pipe 42 having a radial portion containing a bellows 44, and the interior of vessel 10 communicates with tank 26 via a pipe 46 having radial portion containing a bellows 48. Within vacuum vessel 20, pipe 42 is provided with a remotely controllable valve 50 and pipe 46 is provided with a remotely controllable valve 52. Pipes 38, 42 and 46 are disposed in a nested arrangement so that during transfer of cryogens, each cryogen continues to enclose, and insulate, the next lower temperature cryogen.

Bellows 40, 44 and 48 permit radial movements of vessels 6, 8 and 10 as they undergo changes in temperature.

When vessels 6, 8 and 10 are to be purged, it is only necessary to open valves 34, 50 and 52 to cause the cryogens to flow toward tanks 22, 24 and 26. If purging occurs because of the existence of a condition which has produced a temperature increase in vessels 6, 8 and 10, there will develop a gas pressure which helps to drive the cryogens into tanks 22, 24 and 26.

In order to aid the transfer of cryogen from vessel 6, there is additionally provided a gaseous helium supply 56 connected to the interior of vessel 6 via piping 58 and a remotely operable valve 60. Preferably, piping 58 communicates with the interior of vessel 6 at locations near the top and bottom of vessel 6. When gaseous helium is introduced via piping 58, this serves to force the liquid helium rapidly into storage tank 22.

To assist in removing cryogens from vessels 8 and 10, the interior of each vessel may be provided, near the top thereof, with an electric heater 62 which, when activated, generates a quantity of gaseous cryogen which acts to force the liquid cryogen into its respective storage tank.

In further accordance with the invention, coil 4 is provided with radial passages 64, each aligned with a respective pipe 30. This provides a plurality of flow paths between the radial exterior side of coil 4 and pipes 30 and assures a rapid and uniform removal of liquid cryogen, and thus a uniform temperature variation across coil 4.

Storage tanks 22, 24 and 26 are provided with separate connections to respective cryogen refrigeration systems.

The conduit system illustrated in FIG. 1 is associated with one circumferential section of the complete coil assembly. A plurality of such systems are distributed around the circumference of the assembly and each system is associated with a respective set of storage tanks.

When cryogens are to be returned from tanks 22, 24 and 26 to vessels 6, 8 and 10, this can be achieved by means of suitable pumps which act directly on the cryogens in the storage tanks or which create reduced pressure conditions in vessels 6, 8 and 10.

In an exemplary solenoid coil employed in an installation according to the invention, which coil is of large size, each passage 64 could have a height of the order of 2.5 cm and a width of the order of 7–16 cm. The coil could be constructed in the manner disclosed in our co-pending application, entitled SUPERCONDUCTING SOLENOID COIL STRUCTURE, filed on or about the same date as the present application.

While the embodiment described is composed of vessels which are each to be filled with a respective cryogen, it is alternatively possible to confine the neon and nitrogen cryogens to shrouds on the interior walls of vessels 8 and 10. The remainder of each of these vessels would be maintained under a vacuum.

Figure 2:
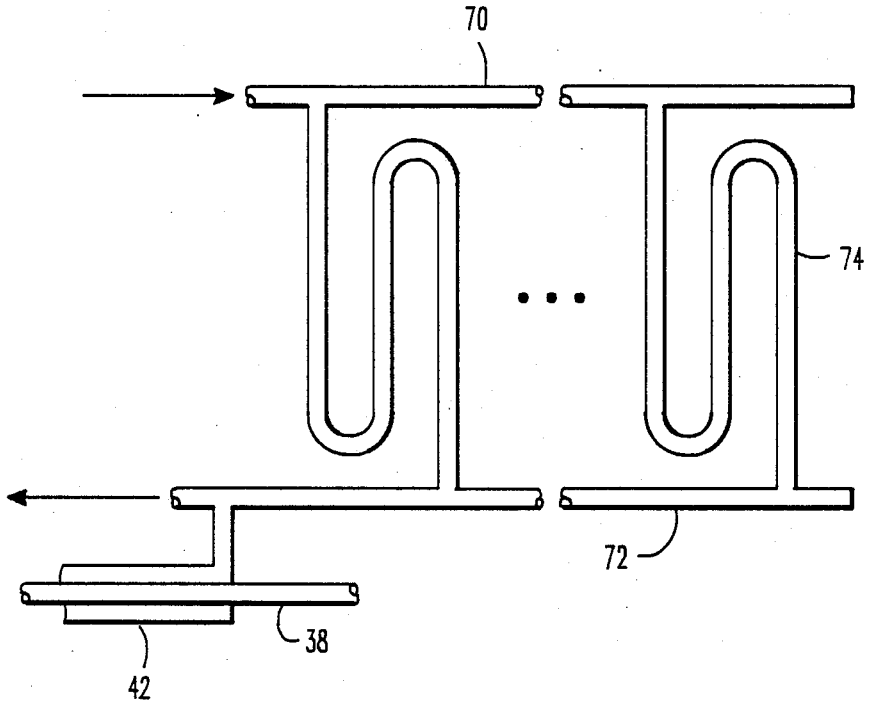
FIG. 2 is a diagrammatic view of a component which can be employed in one type of installation embodying the present invention.

One example of such a shroud for neon is illustrated in FIG. 2. This shroud is composed of an inlet manifold pipe 70 connected to receive neon from an associated refrigeration system and an outlet manifold pipe 72 connected to return neon to the refrigeration system. Between manifold pipes 70 and 72 there are disposed a plurality of tubes 74 which distribute the neon across one surface of vessel 8. While outlet manifold 72 is additionally connected to pipe 42, during normal operation, valve 50 (FIG. 1) will be closed, so that no cryogen flow occurs in pipe 42.

Each circumferential region of coil 4 can be associated with a single shroud mounted on the interior wall of vessel 8 which is spaced radially inwardly from coil 4, and a second shroud can be mounted on the interior wall of vessel 8 which is spaced radially outwardly of coil 4.

Thus, the arrangement according to the present invention permits a more uniform temperature change in coil 4, as a result of flow of cryogen through a plurality of pipes 30 distributed vertically along coil 4 and because of the presence of passages 64. In a typical system embodying the invention, it is envisioned that as many as 12 pipes 30 and associated valves 34 would be provided. This number can be varied, of course, depending on the dimensions of coil 4. This arrangement additionally assures a rapid and uniform cooldown of coil 4 when helium is reintroduced into vessel 6.

Because communication with the interior of vessel 6 occurs via a plurality of pipes 30, each pipe can be associated with a comparatively small valve of a type which has already been developed. If it were otherwise necessary to employ a single valve, a relatively large valve would be required, and this would necessitate an additional development effort.

During introduction of helium into vessel 6, the provision of passages 64 assures a more uniform distribution of the helium to both sides of coil 4.

While the provision of passages 64 will require an increase in the overall height of coil 4, this increase is more than offset by the location of tanks 22, 24 and 26 to one side of lining 2.

Radial movements of vessels 6, 8 and 10 as their temperatures vary will be absorbed by the action of bellows 40, 44 and 48.

In view of the disposition of storage tanks 22, 24 and 26 to one side of lining 2, vessels 6, 8 and 10 and coil 4 can be directly supported on the floor of lining 2 by pedestals 14. Moreover, this disposition of storage tanks 22, 24 and 26 makes them more accessible from ground level and thus facilitates the removal of cryogens from storage tanks 22, 24 and 26, and permits easy access to the equipment enclosed by lining 18.

With the arrangement according to the invention, all cryogens can be removed from their associated vessels to respective storage tanks. This avoids the loss of cryogens, with the attendant expense of replacing them.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. In an installation including a superconducting solenoid coil in the form of an annulus having a vertical axis, a first vessel having an annular form and enclosing the coil for containing a primary cryogen at a temperature sufficient to maintain the coil superconductive, and at least one second vessel having an annular form and enclosing the first vessel for containing a secondary cryogen at a selected temperature, the improvement comprising:

cryogen storage means spaced horizontally from said coil and said vessels for receiving the cryogens contained in said vessels; and conduit means coupled between said vessels and said storage means for permitting the flow of cryogens therebetween.

2. An arrangement as defined in claim 1 wherein said conduit means comprise components for permitting movements of said vessels relative to said storage means transverse to the vertical axis of the coil.

3. An arrangement as defined in claim 2 wherein said conduit means include a plurality of conduits each coupled to a respective vessel and each having a portion extending transversely to the vertical axis of the coil, and said components include a respective bellows disposed in said transversely extending portion of each said conduit.

4. An arrangement as defined in claim 1 wherein said conduit means comprise: a first conduit assembly coupled between said first vessel and said cryogen storage means, and said first conduit assembly comprises: a plurality of pipes spaced apart along the vertical axis of the coil and each communicating with the interior of said first vessel; and a manifold connected between said pipes and said cryogen storage means.

5. An arrangement as defined in claim 4 wherein said first conduit assembly further comprises a plurality of remotely operable valves each connected in a respective one of said pipes.

6. An arrangement as defined in claim 4 wherein said coil is provided with a plurality of fluid flow passages extending through said coil transversely to the vertical axis of said coil, with each said passage being aligned with a respective one of said pipes.

7. An arrangement as defined in claim 1 wherein said cryogen storage means comprise a first cryogen storage tank connected to said conduit means for receiving the primary cryogen from said first vessel, and a second storage tank surrounding said first storage tank to form, with said first storage tank, an annular storage space, said second storage tank being connected to said conduit means for receiving, in said annular storage space, the secondary cryogen from said second vessel.

8. An arrangement as defined in claim 7 wherein said conduit means comprise a first conduit connected to form a fluid flow path between said first vessel and said first storage tank, and a second conduit connected to form a fluid flow path between said second vessel and said second storage tank, said second conduit surrounding said first conduit so that the fluid flow path defined by said second conduit is an annular flow path surrounding said first conduit.

9. An arrangement as defined in claim 1 disposed below ground level in a trench provided with a concrete lining defining a horizontal floor, and further comprising structural support means supporting said coil and said vessels directly from the lining floor.

10. An arrangement as defined in claim 1 further comprising a source of primary cryogen in gaseous form, and piping means connected between said source and said first vessel for controllably supplying the primary cryogen in gaseous form from said source to the interior of said first vessel.

11. An arrangement as defined in claim 1 further comprising heater means disposed in said second vessel for heating the secondary cryogen to place the secondary cryogen in a gaseous state.

12. An arrangement as defined in claim 11 wherein said heater means are disposed in the vicinity of the upper end of said second vessel.

13. In an installation disposed below ground level in a trench provided with a concrete lining defining a horizontal floor, the installation including a superconducting solenoid coil in the form of an annulus having a vertical axis, a first vessel having an annular form and enclosing the coil for containing a primary cryogen at a temperature sufficient to maintain the coil superconductive, and at least one second vessel having an annular form and enclosing the first vessel for containing a secondary cryogen at a selected temperature, the improvement comprising:

cryogen storage means spaced horizontally from said coil and said vessels for receiving the cryogens contained in said vessels;

conduit means coupled between said vessels and said storage means for permitting the flow of cryogens therebetween;

structural support means supporting said coil and said vessels directly from the lining floor;

a source of primary cryogen in gaseous form, and piping means connected between said source and said first vessel for controllably supplying the primary cryogen in gaseous form from said source to the interior of said first vessel; and heater means disposed in the vicinity of the upper end of said second vessel for heating the secondary cryogen to place the secondary cryogen in a gaseous state; wherein:

said cryogen storage means comprise a first cryogen storage tank connected to said conduit means for receiving the primary cryogen from said first vessel, and a second storage tank surrounding said first storage tank to form, with said first storage tank, an annular storage space, said second storage tank being connected to said conduit means for receiving, in said annular storage space, the secondary cryogen from said second vessel, said conduit means comprise a first conduit connected to form a fluid flow path between said first vessel and said first storage tank, and a second conduit connected to form a fluid flow path between said second vessel and said second storage tank, said second conduit surrounding said first conduit so that the fluid flow path defined by said second conduit is an annular flow path surrounding said first conduit, each conduit having a portion extending transversely to the vertical axis of the coil, and a respective bellows disposed in said transversely extending portion of each said conduit for permitting movements of said vessels relative to said storage means transverse to the vertical axis of the coil, said conduit means further comprise: a plurality of pipes spaced apart along the vertical axis of the coil and each communicating with the interior of said first vessel; a manifold connected between said pipes and said cryogen storage means; and a plurality of remotely operable valves each connected in a respective one of said pipes, and said coil is provided with a plurality of fluid flow passages extending through said coil transversely to the vertical axis of said coil, with each said passage being aligned with a respective one of said pipes.

* * * * *